US008148656B2

(12) United States Patent
Orr et al.

(10) Patent No.: US 8,148,656 B2
(45) Date of Patent: Apr. 3, 2012

(54) BUTTON GUIDE

(75) Inventors: Krista Lynn Orr, Plymouth, MI (US); Sabin Oana, Howell, MI (US)

(73) Assignee: Vistcon Global Technologies, Inc., Van Buren Township, MI (US)

( * ) Notice: Subject to any disclaimer, the term of this patent is extended or adjusted under 35 U.S.C. 154(b) by 1297 days.

(21) Appl. No.: 11/624,685

(22) Filed: Jan. 18, 2007

(65) Prior Publication Data

US 2008/0173642 A1 Jul. 24, 2008

(51) Int. Cl.
*H01H 3/60* (2006.01)

(52) U.S. Cl. ..... 200/314; 220/4.02; 200/315; 200/317; 200/341; 200/345

(58) Field of Classification Search ..... 220/4.02, 220/3.5, 3.2; 200/314, 315, 317, 341, 345, 200/5 A See application file for complete search history.

(56) References Cited

U.S. PATENT DOCUMENTS

| | | | | |
|---|---|---|---|---|
| 4,359,619 | A * | 11/1982 | Bergoltz | 200/333 |
| 4,939,324 | A * | 7/1990 | English et al. | 200/345 |
| D323,613 | S | 2/1992 | Cummins et al. | |
| 5,324,902 | A * | 6/1994 | Shen | 200/517 |
| 5,477,942 | A | 12/1995 | Shea et al. | |
| 5,651,450 | A | 7/1997 | Priesemuth | |
| 5,670,759 | A * | 9/1997 | Hsu | 200/5 A |
| 5,739,486 | A | 4/1998 | Buckingham | |
| 6,184,481 | B1 * | 2/2001 | Chen | 200/5 A |
| 6,242,705 | B1 * | 6/2001 | Huang | 200/520 |
| 6,300,582 | B1 * | 10/2001 | Huang | 200/302.2 |
| 6,310,308 | B1 | 10/2001 | Watson et al. | |
| 6,335,500 | B1 | 1/2002 | Chi et al. | |
| 6,743,993 | B1 * | 6/2004 | Clark et al. | 200/314 |
| 6,770,829 | B1 | 8/2004 | Hart | |
| 6,809,278 | B2 * | 10/2004 | Tsubaki | 200/341 |
| 6,998,554 | B2 | 2/2006 | Shimoda et al. | |
| 7,067,754 | B2 | 6/2006 | Weston et al. | |
| 7,122,756 | B2 | 10/2006 | Sasaki et al. | |
| 7,164,092 | B2 * | 1/2007 | Kawano | 200/310 |
| 7,507,924 | B2 * | 3/2009 | Lorenzo Riera et al. | 200/314 |
| 2005/0274593 | A1 * | 12/2005 | Kawano | 200/314 |
| 2005/0279618 | A1 | 12/2005 | Lau et al. | |

FOREIGN PATENT DOCUMENTS

| | | |
|---|---|---|
| EP | 0 925 968 | 6/1999 |

OTHER PUBLICATIONS

U.S. Appl. No. 11/804,526, filed May 19, 2007, Daren L. Harris.

* cited by examiner

*Primary Examiner* — Anthony Stashick
*Assistant Examiner* — Christopher McKinley
(74) *Attorney, Agent, or Firm* — Brinks Hofer Gilson & Lione

(57) ABSTRACT

A push-button assembly has a button retainer having a first side wall connected to a second side wall, with an included angle between the first and second side wall being in the range of about 100 degrees to about 170 degrees. Additional side walls connect the second side wall back to the first side wall, forming a hollow portion within the button retainer. The button retainer can be mated within the channel of a corresponding bezel structure. The bezel structure can be tuned to fit the button retainer along a single axis of the bezel structure. A tune-to-fit process includes forming the bezel structure from a mold and measuring the fit of the button retainer within the bezel structure along an x-axis. The bezel mold is either re-cut or material is added to the bezel mold along the x-axis, without re-cutting or adding material along any other axis.

12 Claims, 5 Drawing Sheets

BUTTON GUIDE

BACKGROUND

1. Field of the Invention

The present invention generally relates to push-button assemblies. More specifically, the invention relates to push-button assemblies having a button retainer and a lightable area.

2. Description of Related Art

Push-buttons are used to control a wide variety of electronic equipment, including electronic equipment within automobiles. Examples of such uses are buttons for audio applications, driver's information applications, climate control, four-wheel drive activation/deactivation, door switches, and seat movement applications, to name a few.

Push-buttons having a transparent or translucent display portion on the front surface are known in the art. These types of push-buttons have a light guiding portion, called the button retainer, extending from the back of the push-button and extending through a bezel structure. Often, multiple button guides protrude from the side of the button retainer in order to control friction and wobble. An example of a prior art button retainer 8 is shown in FIG. 1.

Button retainers and bezel structures of the type herein are generally made of plastic and injection molded from steel molds. In order to minimize both the friction between the button retainer and the bezel structure and the wobble of the button retainer within the bezel structure, the button retainer and corresponding bezel structure must meet accurate tolerances. Often, as friction is decreased, wobble increases, and vice versa.

In addition to controlling friction and wobble, button design also involves maximizing the lightable area, minimizing the gap between the button retainer and the bezel structure, ensuring adequate button travel, and maximizing the durability of the button assembly. Attempting to satisfy all of these design parameters causes a button to become over-constrained.

With reference to FIG. 1, the prior art button retainer 8 is mated within a bezel structure 9. The button retainer 8 has multiple drawer slide button guides 10 protruding from it. These button guides 10 are designed to control friction and wobble of the button retainer 8 within the bezel structure 9.

The bezel structure 9 is tuned to fit the button retainer 8 by a process that involves cutting the mold for the bezel structure 9 to one side of a predetermined tolerance band, leaving gaps for the button guides 10. The bezel structure 9 is injection molded, and the button retainer 8 is fit within the bezel structure 9. Measurements are made for adjusting the bezel mold to fit the button guides 10 to accurate tolerances. Then, the bezel mold is re-cut or material is added to the bezel mold. Tuning the multiple button guides 10 in three dimensions along multiple axes is difficult to control and difficult to package, especially now that bezel structures 9 are designed with computers.

In view of the above, it is apparent that there exists a need for a button guide and bezel structure in which tuning the button retainer to fit within the bezel structure is easier to control and more accurate.

SUMMARY

In satisfying the above need, as well as overcoming the enumerated drawbacks and other limitations of the related art, the present invention provides a button retainer for use in a push-button assembly. The button retainer has a first side wall and a second side wall that is connected to the first side wall. The included angle between the first side wall and the second side wall is in the range of about 100 degrees to about 170 degrees. A third side wall is connected to the second side wall. At least one additional side wall connects the third side wall to the first side wall. Together, the side walls form a hollow portion within the button retainer.

In another aspect, a push-button assembly is provided that includes a button retainer and a bezel structure. The button retainer has a first side wall and a second side wall that is connected to the first side wall. The included angle between the first side wall and the second side wall is in the range of about 100 degrees to about 170 degrees. A third side wall is connected to the second side wall. At least one additional side wall connects the third side wall to the first side wall. Together, the side walls form a hollow passage within the button retainer. The bezel structure has a channel formed therein. The button retainer is mated within the channel of the bezel structure.

In another aspect, a push-button assembly is provided that includes a button retainer and a bezel structure. The button retainer has a plurality of side walls connected to form a hollow portion within the button retainer. The button retainer is mated within the bezel structure. The bezel structure is tuned to a design gap with the button retainer of a predetermined tolerance along an x-axis, and the bezel structure is not tuned along any other axis.

In another aspect, a method of producing a push-button assembly is provided. The method includes forming a button retainer having a first side wall and a second side wall connected to the first side wall. The included angle between the first side wall and the second side wall is in the range of about 100 degrees to about 170 degrees. A third side wall is connected to the second side wall. At least one additional side wall connects the third side wall to the first side wall. The side walls form a hollow portion within the button retainer. The method includes, in a first instance, cutting a bezel mold to one side of a predetermined tolerance band for a bezel structure along an x-axis. The bezel structure has a channel configured to mate with the button retainer. The method also includes, in a first instance, forming the bezel structure from the bezel mold. The method further includes tuning the fit of the button retainer within the bezel structure using a tuning process that involves mating the button retainer within the bezel structure and measuring the fit of the button retainer within the bezel structure along the x-axis; if the button retainer does not fit within the bezel structure, cutting the bezel mold in a second instance along the x-axis, without cutting the bezel mold along any other axis; and, if the button retainer does fit within the bezel structure, and a gap along the x-axis exceeds a predetermined limit, adding material to the bezel mold along the x-axis, without adding material along any other axis. Unless the gap along the x-axis is less than the predetermined limit, the method includes, in a second instance, forming the bezel structure from the bezel mold. The method includes repeating the tuning process until both the button retainer fits within the bezel structure and the gap along the x-axis of the button retainer within the bezel structure does not exceed the predetermined limit.

Further objects, features, and advantages of this invention will become readily apparent to persons skilled in the art after a review of the following description, with reference to the drawings and claims that are appended to and form a part of this specification.

DETAILED DESCRIPTION

Figure 2:
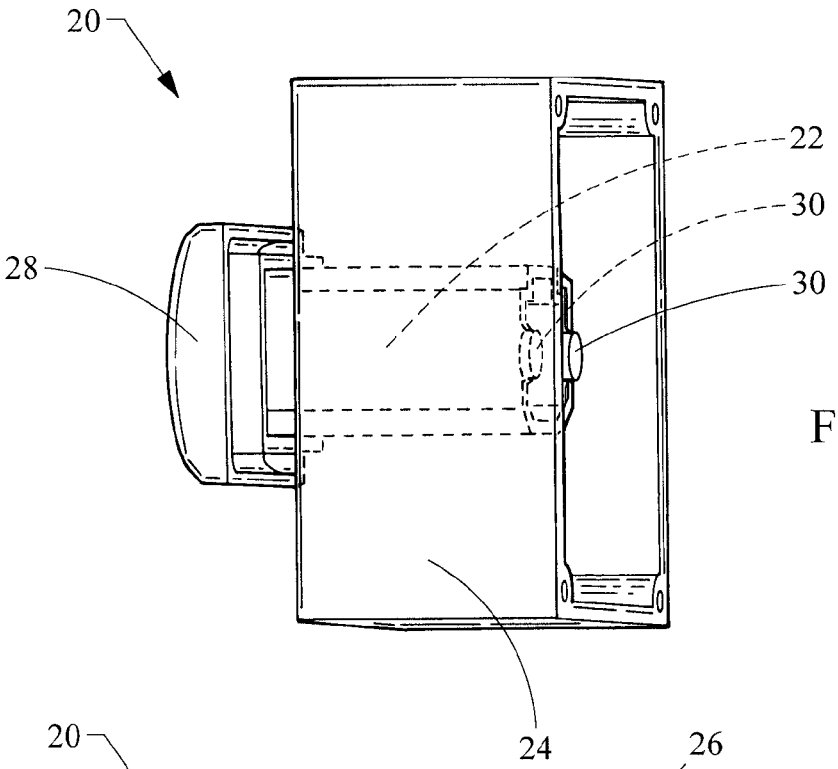
FIG. 2 is a side perspective view of a push-button assembly embodying the present invention, including a button retainer.

Referring to FIGS. 2 and 3, a first embodiment of a push-button assembly embodying the principles of the present invention is designated generally at 20. The push-button assembly 20 includes a button retainer 22 that is mated within a channel 26 formed as part of a bezel structure 24. The button retainer 22 has a push-button top 28 connected thereto. Alternatively, the push-button top 28 may be integrally formed with the button retainer 22. The rear side of the button retainer 22 has at least one pad 30. The pads 30 could be connected to the button retainer 22 or integrally formed with the button retainer 22. The pads 30 contact electric contacts (not shown), or switchmat domes, in order to activate a desired function. The pads 30 are about 1.0 mm larger than the electric contacts or switchmat domes with which they cooperate.

Figure 1:
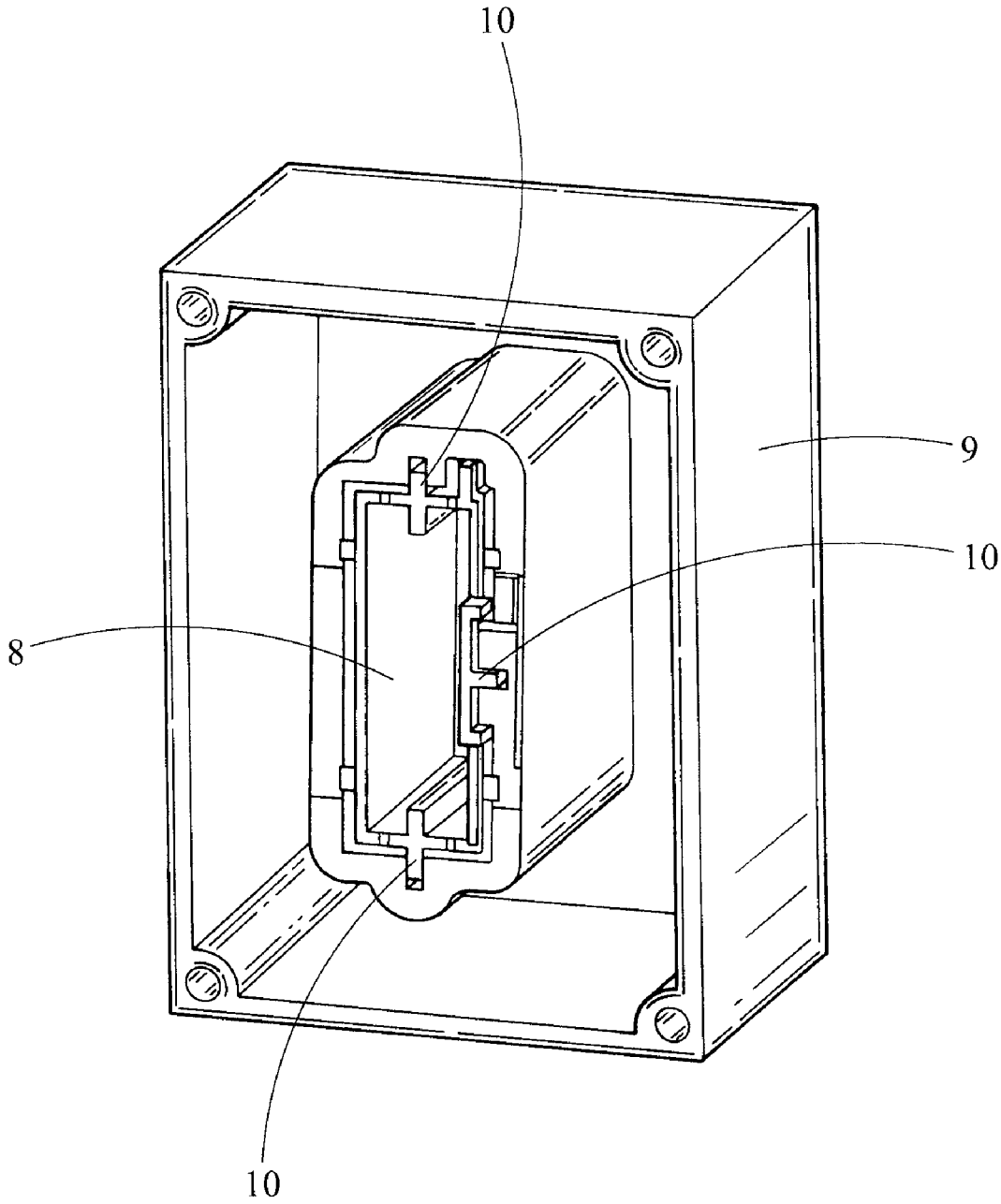
Fig. 1 (Prior Art)
FIG. 1 is a rear perspective view of a prior art push-button assembly.

The button retainer 22 has a plurality of side walls 32-42 defining a closed structure, which are connected to form a hollow portion within the button retainer 22. The plurality of side walls 32-42 form a passage through the button retainer 22 or a cavity within the button retainer. The side walls of the button retainer 22 are configured such that there is no need for solid button guides 10 (shown in FIG. 1) to protrude therefrom, although such button guides 10 may optionally be used. The button retainer 22 is mated within the channel 26 so that the plurality of side walls 32-42 of the button retainer 22 are line-to-line, in other words, surface-to-surface, with the interior walls 52-62 of the channel 26 of the bezel structure 24. As a result of the present construction, the bezel structure 24 is tuned only along an x-axis (shown in FIG. 4), which extends along one plane of the side walls of the button retainer 22.

Figure 4A:
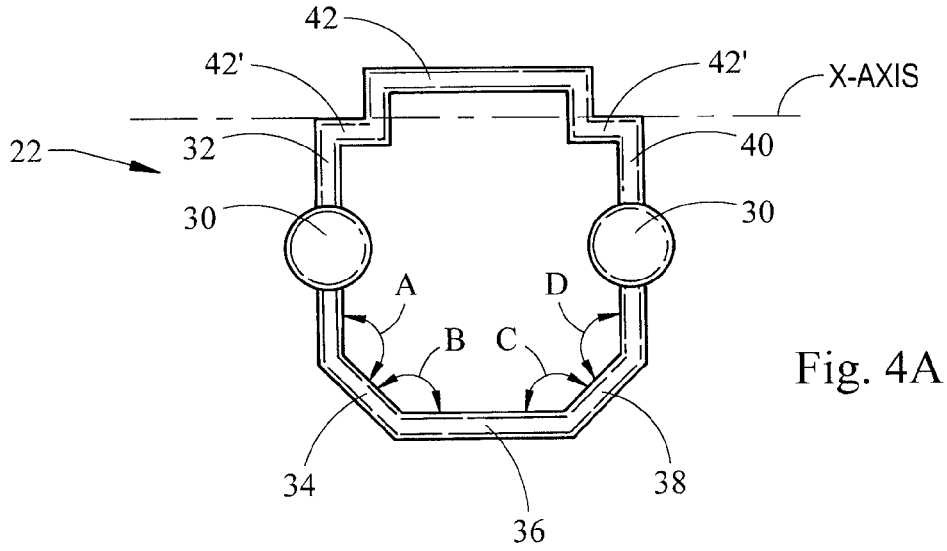
FIG. 4A is a rear view of the button retainer seen in FIGS. 2, 3A, and 3B.

Referring to FIG. 4A, the button retainer 22 has a first side wall 32 connected to a second side wall 34, so as to define an included angle A therebetween. Preferrably, the included angle A is in the range of about 100 degrees to about 170 degrees, and more preferably about 135 degrees. A third side wall 36 is connected to the second side wall 34, the third side wall 36 being oriented along a plane about 90 degrees from the plane of the first side wall 32. A fourth side wall 38 is connected to the third side wall 36.

The second side wall 34 and the fourth side wall 38 form angles with the plane of the third side wall 36, in the range of about 10 degrees to about 80 degrees, and preferably about 45 degrees. In other words, the included angles B and C between the second side wall 34 and the third side wall 36, and between the third side wall 36 and fourth side wall 38, respectively, are each in the range of about 100 degrees to about 170 degrees, preferably about 135 degrees.

Continuing around the edge of the button retainer 22, a fifth side wall 40 is connected to the fourth side wall 38, with an included angle D in the range of about 100 degrees to about 170 degrees, and preferably about 135 degrees. The fifth side wall 40 is oriented along a plane about that is about 90 degrees from the plane of the third side wall 36 and that is parallel with the plane of the first side wall 32.

A sixth side wall 42 connects the fifth side wall 40 back to the first side wall 32. As illustrated in FIG. 4A, the sixth side wall 42 is generally provided with a "top hat" shape. A tuning axis, the x-axis, extends generally along the side portions 42' of the "top hat" shape of the sixth side wall 42. With the present construction, the bezel structure 24 is capable of being tuned to fit the button retainer 22, only tuning along the plane of the side portions 42' of the sixth side wall 42. In other words, the bezel structure 24 can be tuned without needing to be tuned along any other axis.

Figure 3A:
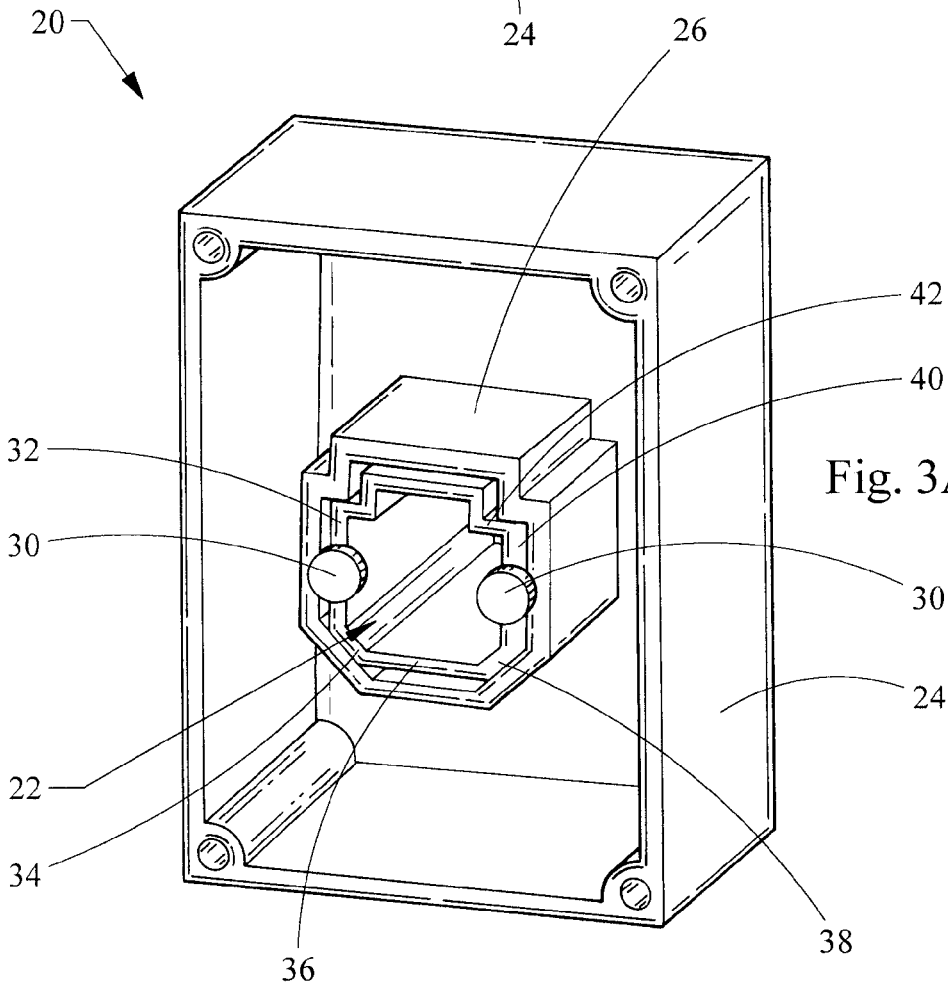
FIG. 3A is a rear perspective view of the push-button assembly of FIG. 2.
Figure 3B:
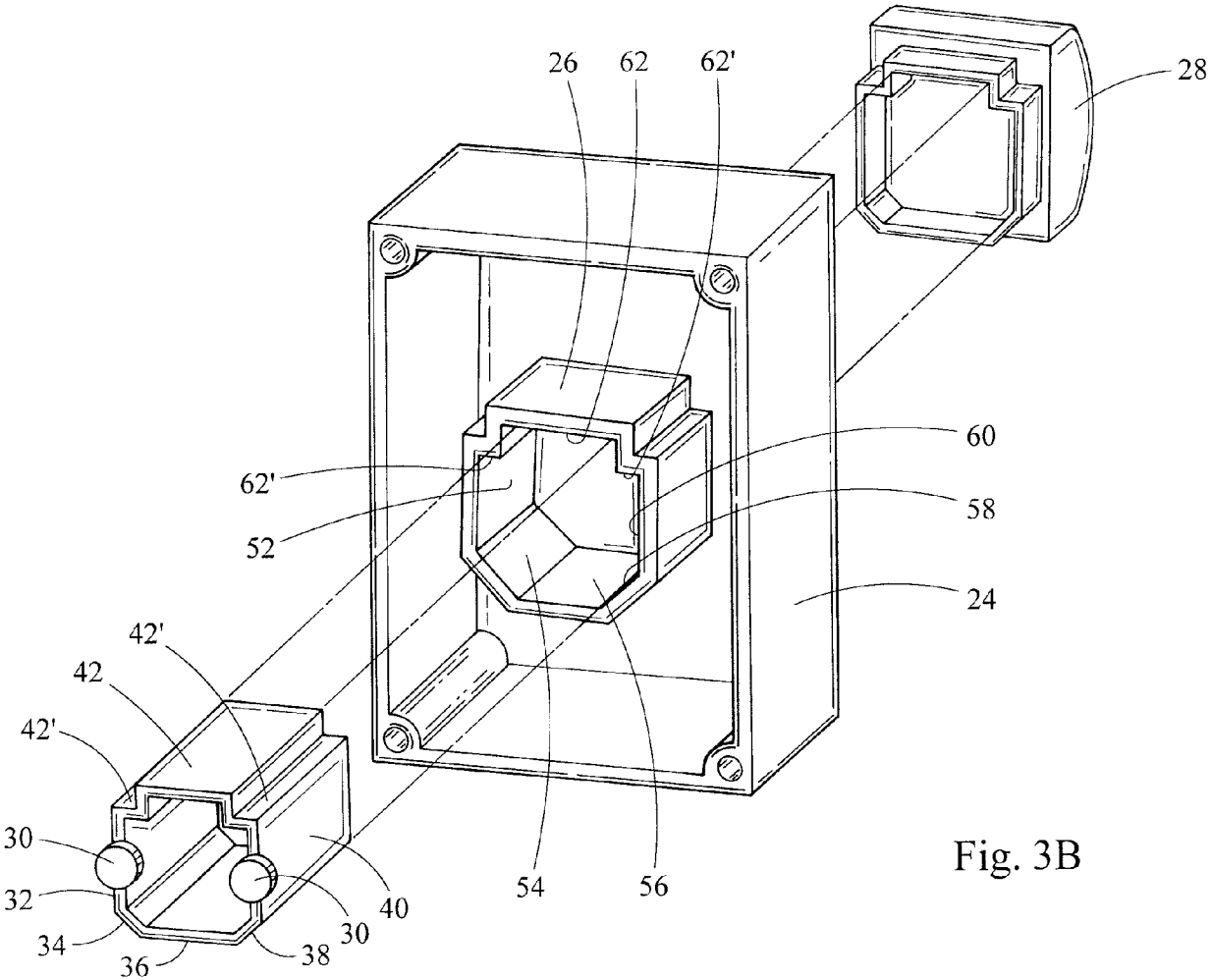
FIG. 3B is an exploded view of the push-button assembly of FIGS. 2 and 3A.

As described above, the various side walls 32-42 define a closed structure, corresponding in shape to the interior shape of the channel 26, with a passage through or cavity in the button retainer 22. With reference to FIGS. 3A and 3B, when the button retainer 22 is mated within the channel 26 of the bezel structure 24, the inside walls of the channel 26 correspond to each of the side walls of the button retainer 22. Accordingly, the first side wall 32 of the button retainer 22 mates with the first interior wall 52 of the channel 26. The second side wall 34 of the button retainer 22 mates with the second interior wall 54 of the channel 26. Likewise, the rest of the side walls 36-42 mate with the rest of the interior walls 56-62. This allows the second side wall 34 and the fourth side wall 38 to serve as 45-degree button guides that ride along the corresponding interior walls 54, 58 of the bezel structure 24 (as illustrated in FIGS. 3A and 3B). The angle of the button guides may be in the range of about 10 to about 80 degrees; they are shown at 45-degree angles in FIGS. 3A and 3B.

Accordingly, with reference to FIG. 4A, the second side wall 34, which may be called a first bottom side wall 34, is oriented on a plane in the range of about 10 degrees to about 80 degrees from the plane of the x-axis. The fourth side wall 38, which may be called a second bottom side wall 38, is oriented on a plane in the range of about 10 degrees to about 80 degrees from the plane of the x-axis. The plane of the second bottom side wall 38 is oriented in the range of about 20 degrees to about 160 degrees from the plane of the first bottom side wall 34.

The various side walls 32-42 of the button retainer 22 do not include solid button guides 10 (shown in FIG. 1) protruding therefrom. Because the second side wall 34 and the fourth side wall 38 are located on a plane that is on an angle from the plane of the x-axis, the second side wall 34 and fourth side wall 38 serve as button guides for the button retainer 22, obviating the need for solid button guides 10 that protrude from the side walls of prior button retainers 8.

Figure 4B:
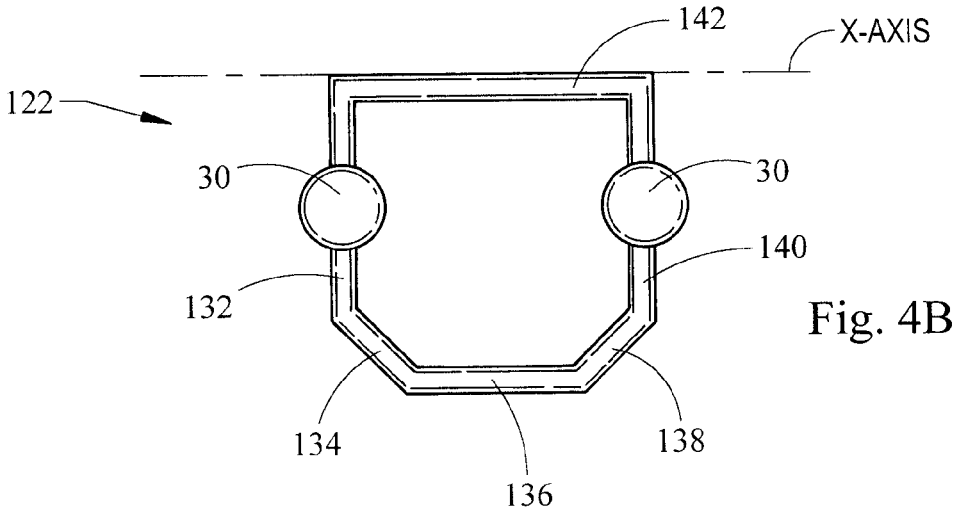
FIG. 4B is a rear view of a second embodiment of a button retainer embodying the invention.

FIGS. 4B, 4C, 4D, and 4E show alternative embodiments of the present invention. Referring to FIG. 4B, a second embodiment of a button retainer 122 is illustrated. The second side wall 134 and the fourth side wall 138 of the button retainer 122 ride along the bezel structure and serve as button guides, as in the button retainer 22 of FIG. 4A. The configuration of the first side wall 132, second side wall 134, third side wall 136, fourth side wall 138, and fifth side wall 140 is substantially the same as the side walls 32, 34, 36, 38, 40 of FIG. 4A. The sixth side wall 142 is, however, of a straight wall configuration between the first side wall 132 and the fifth side wall 140. There is no "top hat" portion of the sixth side wall 142. Nonetheless, the bezel structure is tuned along only the x-axis, which extends along the sixth side wall 142.

Figure 4C:
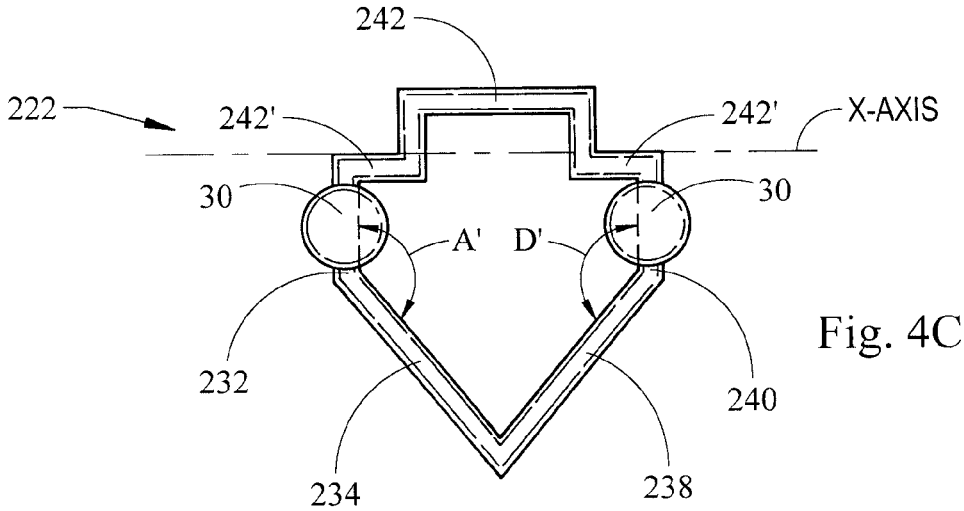
FIG. 4C is a rear view of a third embodiment of a button retainer embodying the invention.

FIG. 4C illustrates a third embodiment of a button retainer 222, in which the third side wall 36, 136 of the previous embodiments is eliminated. With this wall eliminated, the second and fourth side walls 234, 238 are extended so as to join together. (For the sake of consistency with the other embodiments, the fourth side wall 238 is being referred to as a "fourth" wall even though no corresponding "third" wall exists in this embodiment. The same is true for other corresponding side walls.) Similar to the first embodiment (albeit shorter as illustrated), a first side wall 232 extends parallel to a fifth side wall 240 and generally perpendicular to a sixth side wall 242. The angle of inclusion A' between the first side wall 232 and the second side wall 234 is in the range of about 100 degrees to about 170 degrees. Likewise, the angle of inclusion D' between the fourth side wall 238 and the fifth side wall 240 is in the range of about 100 degrees to about 170 degrees. Like the first embodiment, the sixth side wall 242 extends between the first and fifth side walls 232, 240 and defines an x-axis, which extends along the side portions 242' of the sixth side wall 242. The bezel structure (not shown) is tuned along the x-axis to fit the button retainer 222.

Figure 4D:
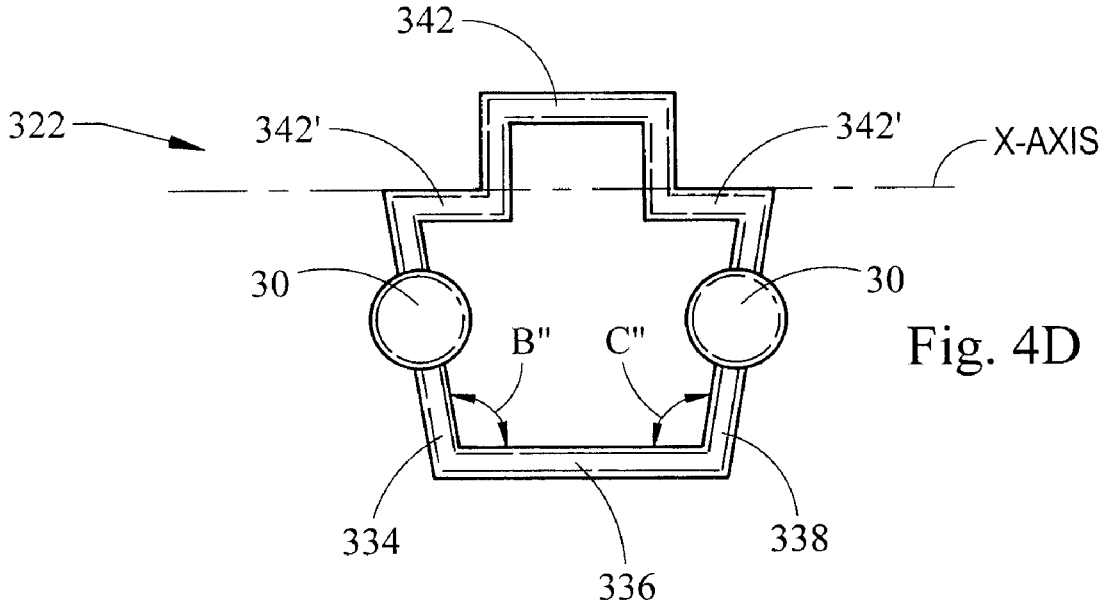
FIG. 4D is a rear view of a fourth embodiment of a button retainer embodying the invention.

FIG. 4D illustrates a fourth embodiment of a button retainer 322, in which the first and fifth side walls of the first embodiment are eliminated. Similar to the discussion with respect to FIG. 4C, the "second", "third", "fourth", and "sixth" side walls are being named as such, even though no corresponding "first" and "fifth" side walls exist in this embodiment, for the sake of consistency with the previous embodiments. The second and fourth side walls 334, 338 are connected to the third side wall 336 with included angles B" and C" in the range of about 100 degrees to about 170 degrees. With the first and fifth side walls eliminated, the second side wall 334 and the fourth side wall 338 are elongate in order to connect the third side wall 336 to the sixth side wall 342. Like the first and third embodiments, the sixth side wall 342 defines an x-axis, which extends along the side portions 342' of the sixth side wall 342. Because the second and fourth side walls 334, 338 extend along planes oriented at an angle from the x-axis, they serve as button guides for the button retainer 322 within the bezel structure (not shown). Therefore, the side walls of the button retainer 322 may be substantially free of solid button guides protruding therefrom. The bezel structure is tuned along the x-axis to fit the button retainer 322, and there is no need to tune the bezel structure along any other axis.

Figure 4E:
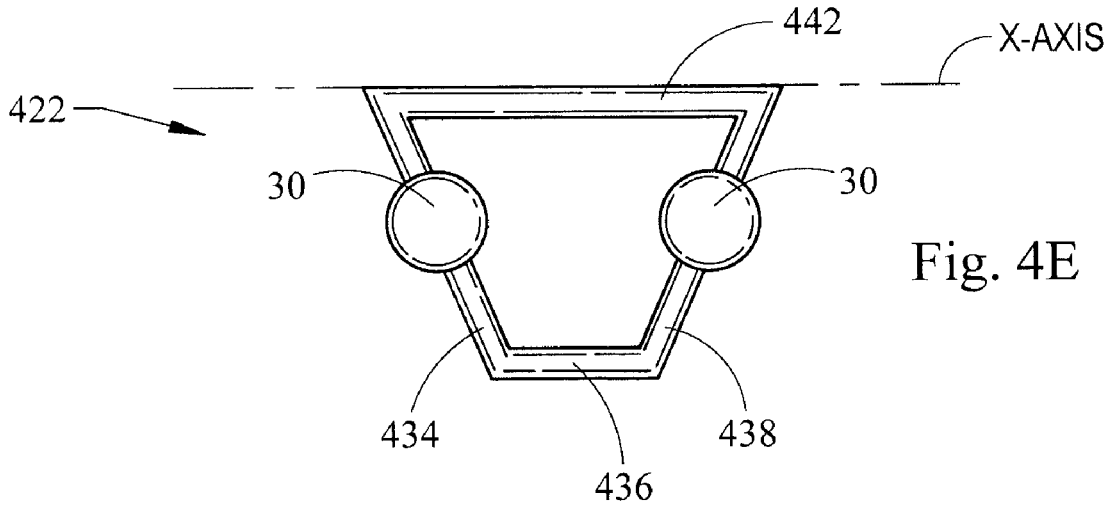
FIG. 4E is a rear view of a fifth embodiment of a button retainer embodying the invention.

FIG. 4E illustrates a fifth embodiment of the button retainer 422 in which the "first" and "fifth" side walls 32, 40 of the button retainer 22, as well as the "top hat" configuration of the sixth side wall 42 of the first embodiment, are eliminated. Similar to the discussion with respect to FIGS. 4C and 4D, the "second", "third", "fourth", and "sixth" side walls are being named as such, even though no corresponding "first" and "fifth" side walls exist in this embodiment, for the sake of consistency with the previous embodiments. The configuration of the second, third, and fourth side walls 434, 436, 438 is substantially the same as that in FIG. 4D. Accordingly, the second and fourth side walls 434, 438 serve as button guides for the button retainer 422 within the bezel structure (not shown). The configuration of the sixth side wall 442 is substantially the same as the sixth side wall 142 of the second embodiment (FIG. 4B), which has a straight wall configuration with no "top hat" portion. Like the previous embodiments illustrated herein, the bezel structure is tuned along only the x-axis, which extends along the sixth side wall 442.

The button retainer 22 and bezel structure 24 are preferably formed by injection molding a plastic material using a steel mold, and preferably, the button retainer 22 is made with Delrin polyoxymethylene (POM), sold by DuPont. The bezel structure 24 is preferably constructed of acrylonitrile butadiene styrene (ABS). Additionally, the button retainer 22 is preferably lubricated with a synthetic, electronic approved grease, particularly along the second and fourth side walls 34, 38, which serve as button guides.

Referring to FIG. 4A, the bezel structure 24 only needs to be tuned to fit the button retainer 22 along the x-axis. In doing this, a mold for forming the bezel structure 24 is cut to one side of a predetermined tolerance band for the bezel structure 24 along the x-axis. The bezel structure 24 is formed in the mold, in a first instance. The button retainer 22 is mated within the bezel structure 24, and the fit of the button retainer 22 within the bezel structure 24 is measured along the x-axis. If the button retainer 22 does not fit within the bezel structure 24, the bezel mold is cut in a second instance along the x-axis. With the button retainer and bezel structure design of the present invention, there is no need to cut the bezel mold along any axis other than the x-axis. If the button retainer 22 does fit within the bezel structure 24 and a gap along the x-axis exceeds the predetermined limit, material is added to the bezel mold along the x-axis. Unless the button retainer fits within the bezel structure and the measurement of the gap along the x-axis is less than the predetermined limit, the bezel structure 24 is formed in a second instance, from the resultant bezel mold, which has either been re-cut or had material added to it.

The process of measuring the fit of the button retainer 22 within the bezel structure 24, re-cutting the bezel mold, and/or adding material to the bezel mold 24 is repeated until both the button retainer 22 fits within the bezel structure 24 and the gap along the x-axis of the button retainer 22 within the bezel structure 24 does not exceed the predetermined limit. The predetermined limit is preferably less than 0.5 mm.

As a person skilled in the art will readily appreciate, the above description is meant as an illustration of implementation of the principles of this invention. This description is not intended to limit the scope or application of this invention in that the invention is susceptible to modification, variation, and change without departing from the spirit of this invention, as defined in the following claims.

We claim:

1. A button retainer for use in a push-button assembly, comprising:

a plurality of side walls defining a closed structure;

a first side wall of the plurality of side walls;

a second side wall of the plurality of side walls, the second side wall being immediately adjacent and connected to the first side wall, an included angle between the first side wall and the second side wall being in the range of about 100 degrees to about 170 degrees;

a third side wall of the plurality of side walls being immediately adjacent and connected to the second side wall, an included angle between the second side wall and the third side wall is in the range of about 100 degrees to about 170 degrees, the third side wall being oriented along a plane being about 90 degrees from the plane of the first side wall;

a fourth side wall of the plurality of side walls being immediately adjacent and connected to the third side wall, an included angle between the third side wall and the fourth side wall is in the range of about 100 degrees to about 170 degrees;

a fifth side wall of the plurality of side walls being immediately adjacent and connected to the fourth side wall, an included angle between the fourth side wall and the fifth side wall being in the range of about 100 degrees to about 170 degrees, the fifth side wall being oriented along a plane being about 90 degrees from the plane of the third side wall and being parallel with the plane of the first side wall;

at least one additional side wall of the plurality of side walls connecting the fifth side wall to the first side wall; and wherein the plurality of side walls form a hollow portion within the button.

2. The button retainer of claim 1, wherein the plurality of side walls are substantially free of button guides protruding therefrom.

3. The button retainer of claim 1, wherein the included angle between the first side wall and the second side wall is about 135 degrees.

4. A push-button assembly comprising:

a button retainer comprising:

a plurality of side walls defining a closed structure;

a first side wall of the plurality of side walls;

a second side wall of the plurality of side walls, the second side wall being immediately adjacent and connected to the first side wall, an included angle between the first side wall and the second side wall being in the range of about 100 degrees to about 170 degrees;

a third side wall of the plurality of side walls being immediately adjacent and connected to the second side wall;

at least one additional side wall of the plurality of side walls connecting the third side wall to the first side wall;

wherein the plurality of side walls form a hollow portion within the button retainer; and a bezel structure having a channel formed therein, wherein the button retainer is matingly received within the channel, the channel having a plurality of channel side walls corresponding to the first side wall, the second side wall, the third side wall and the at least one additional side wall of the button retainer.

5. The push-button assembly of claim 4, further comprising at least one pad connected to the button retainer, the pad operable to activate electric contacts.

6. The push-button assembly of claim 4, wherein the plurality of side walls are substantially free of button guides protruding therefrom.

7. The push-button assembly of claim 4, wherein the included angle between the first side wall and the second side wall is about 135 degrees.

8. The push-button assembly of claim 4, wherein an included angle between the second side wall and the third side wall is in the range of about 100 degrees to about 170 degrees, the third side wall being oriented along a plane being about 90 degrees from the plane of the first side wall.

9. The push-button assembly of claim 8, wherein a fourth side wall of the plurality of side walls is immediately adjacent and connected to the third side wall, and an included angle between the third side wall and the fourth side wall is in the range of about 100 degrees to about 170 degrees.

10. A push-button assembly comprising:

a button retainer comprising:

a plurality of side walls defining a closed structure;

a first side wall of the plurality of side walls;

a second side wall of the plurality of side walls, the second side wall being immediately adjacent and connected to the first side wall, an included angle between the first side wall and the second side wall being in the range of about 100 degrees to about 170 degrees;

a third side wall of the plurality of side walls being immediately adjacent and connected to the second side wall, an included angle between the second side wall and the third side wall being in the range of about 100 degrees to about 170 degrees, the third side wall being oriented along a plane being about 90 degrees from the plane of the first side wall;

a fourth side wall of the plurality of side walls being immediately adjacent and connected to the third side wall, an included angle between the third side wall and the fourth side wall is in the range of about 100 degrees to about 170 degrees a fifth side wall of the plurality of side walls being immediately adjacent and connected to the fourth side wall, an included angle between the fourth side wall and the fifth side wall being in the range of about 100 degrees to about 170 degrees, the fifth side wall being oriented along a plane being about 90 degrees from the plane of the third side wall and being parallel with the plane of the first side wall;

wherein the plurality of side walls form a hollow portion within the button retainer; and a bezel structure having a channel formed therein, wherein the button retainer is matingly received within the channel.

11. A push-button assembly comprising:

a button retainer comprising:

a plurality of side walls defining a closed structure;

a first side wall of the plurality of side walls;

a second side wall of the plurality of side walls, the second side wall being immediately adjacent and connected to the first side wall, an included angle between the first side wall and the second side wall being in the range of about 100 degrees to about 170 degrees;

a third side wall of the plurality of side walls being immediately adjacent and connected to the second side wall, an included angle between the second side wall and the third side wall being in the range of about 100 degrees to about 170 degrees, the third side wall being oriented along a plane being about 90 degrees from the plane of the first side wall;

a fourth side wall of the plurality of side walls being immediately adjacent and connected to the third side wall, an included angle between the third side wall and the fourth side wall is in the range of about 100 degrees to about 170 degrees a fifth side wall of the plurality of side walls being immediately adjacent and connected to the fourth side wall, an included angle between the fourth side wall and the fifth side wall being in the range of about 100 degrees to about 170 degrees, the fifth side wall being oriented along a plane being about 90 degrees from the plane of the third side wall and being parallel with the plane of the first side wall;

a sixth side wall of the plurality of side walls being immediately adjacent and connected to the fifth side wall and the first side wall, the sixth side wall further comprising:

a first portion having a surface extending along an x-axis; and a second portion of the sixth side wall protruding outwardly from the first portion, the second portion having a surface extending along an axis parallel to and apart from the x-axis;

at least one additional side wall of the plurality of side walls connecting the sixth side wall to the first side wall;

the plurality of side walls form a hollow portion within the button retainer; and a bezel structure having a channel formed therein, wherein the button retainer is matingly received within the channel, and wherein, the bezel structure is tuned to fit the button retainer only along the x-axis.

12. The push-button assembly of claim 10, wherein a sixth side wall extends straight between the fifth side wall and the first side wall, and the bezel structure is tuned to fit the button retainer only along a plane of the sixth side wall.

* * * * *

UNITED STATES PATENT AND TRADEMARK OFFICE

CERTIFICATE OF CORRECTION

PATENT NO. : 8,148,656 B2
APPLICATION NO. : 11/624685
DATED : April 3, 2012
INVENTOR(S) : Krista Lynn Orr et al.

It is certified that error appears in the above-identified patent and that said Letters Patent is hereby corrected as shown below:

In the Claims

In column 8, claim 10, line 3, immediately after "170 degrees" insert --;--.

In column 8, claim 10, after line 11, insert a new paragraph as follows:

--at least one additional side wall of the plurality of side walls connecting the third side wall to the first side wall;--.

Signed and Sealed this
Nineteenth Day of February, 2013

Teresa Stanek Rea
*Acting Director of the United States Patent and Trademark Office*